US009890622B2

(12) United States Patent
Morrison

(10) Patent No.: US 9,890,622 B2
(45) Date of Patent: Feb. 13, 2018

(54) PROGRESSIVE CAVITY PUMP HOLDBACK APPARATUS AND SYSTEM

(71) Applicant: James Eric Morrison, Shawnee, OK (US)

(72) Inventor: James Eric Morrison, Shawnee, OK (US)

( * ) Notice: Subject to any disclaimer, the term of this patent is extended or adjusted under 35 U.S.C. 154(b) by 99 days.

(21) Appl. No.: 14/956,672

(22) Filed: Dec. 2, 2015

(65) Prior Publication Data

US 2017/0159413 A1 Jun. 8, 2017

(51) Int. Cl.

| | |
|---|---|
| ***E21B 43/12*** | (2006.01) |
| ***E21B 47/02*** | (2006.01) |
| ***F04B 47/02*** | (2006.01) |

(52) U.S. Cl.

CPC ..... *E21B 43/126* (2013.01); *F04B 47/02* (2013.01); *F05B 2240/10* (2013.01); *F05B 2240/20* (2013.01); *F05B 2240/50* (2013.01); *F05B 2240/60* (2013.01)

(58) Field of Classification Search

CPC .... E21B 43/126; F04B 47/02; F05B 2240/10; F05B 2240/20; F05B 2240/50; F05B 2240/60

See application file for complete search history.

(56) References Cited

U.S. PATENT DOCUMENTS

| | | | | |
|---|---|---|---|---|
| 3,030,935 | A * | 4/1962 | Hanes | E21B 43/12 464/163 |
| 3,886,740 | A * | 6/1975 | Krok | F16D 41/067 192/12 B |
| 4,797,075 | A | 1/1989 | Edwards et al. | |
| 6,079,489 | A | 6/2000 | Hult et al. | |
| 6,135,740 | A * | 10/2000 | Hult | E21B 43/126 166/68 |
| 6,289,986 | B1 * | 9/2001 | Wright | F16D 11/04 166/117.7 |
| 6,419,472 | B2 | 7/2002 | Kobensen | |
| 6,564,911 | B2 | 5/2003 | Mills | |
| 6,786,309 | B2 | 9/2004 | Saruwatari et al. | |
| 6,843,313 | B2 | 1/2005 | Hult | |
| 9,541,073 | B2 * | 1/2017 | Rappenecker | F04B 9/045 |

* cited by examiner

*Primary Examiner* — David J Bagnell
*Assistant Examiner* — Yanick A Akaragwe
(74) *Attorney, Agent, or Firm* — Ancel W. Lewis, Jr.; Cochran Freund & Young LLC

(57) ABSTRACT

A progressive cavity pump system on a well includes a holdback apparatus. The holdback apparatus has a housing and a one-way bearing in the housing. The housing attaches to the drive head on the well. The one-way bearing allows the motor to drive the pump. The one-way bearing prevents reverse rotation, preventing the sucker rod from unwinding and fluid above the pump from draining, when the pump loses power.

15 Claims, 4 Drawing Sheets

PROGRESSIVE CAVITY PUMP HOLDBACK APPARATUS AND SYSTEM

TECHNICAL FIELD

The present invention relates to progressive cavity pump systems, and more particularly to a holdback apparatus and system that prevents reverse rotation of the polish rod that drives a progressive cavity pump.

BACKGROUND ART

Progressive cavity pump systems used for pumping liquids, such as crude oil, from wells generally have a drive head above ground with a motor that drives a polish rod. The polish rod extends downwardly through a stuffing box at the top of the well casing and connects with the top of a sucker rod that drives the progressive cavity pump at the bottom of the well.

The sucker rod can extend downwardly several thousand feet. During operation of the pump, the sucker rod twists in response to the torque applied by the motor. The sucker rod can have several hundred revolutions of twist. When the motor is shut down or loses power, the torsional energy in the sucker rod can backspin the polish rod and motor at a high speed, potentially causing damage to the drive head and motor, and injuring personnel.

Several prior known devices controlled the rate of backspin while releasing the torsional energy stored in the sucker rod. These devices include hydraulic or viscous brakes, and mechanical brakes actuated by hydraulic or centrifugal force. Generally these devices are relatively complex. These devices release the torsional energy and the twist in the sucker rod, so that when the motor is restarted, the motor rotates the polish rod several hundred revolutions before the pump starts to pump again, wasting time and energy.

DISCLOSURE OF THE INVENTION

A progressive cavity pump system has a drive head, a polish rod, a motor, a sucker rod, a pump, and a holdback apparatus. The drive head is mounted on the well head on top of the casing for a well. The polish rod is rotatably mounted in the drive head. The motor drives the polish rod. The sucker rod is connected to and extends downwardly from the polish rod to the pump. The holdback apparatus includes a holdback housing and a one-way bearing. The holdback housing is rigidly attached to the drive head. The one-way bearing has an outer race that is pressed into the holdback housing and an inner race that connects to the polish rod. The inner race rotates in only one direction relative to the outer race and prevents reverse rotation of the polish rod.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
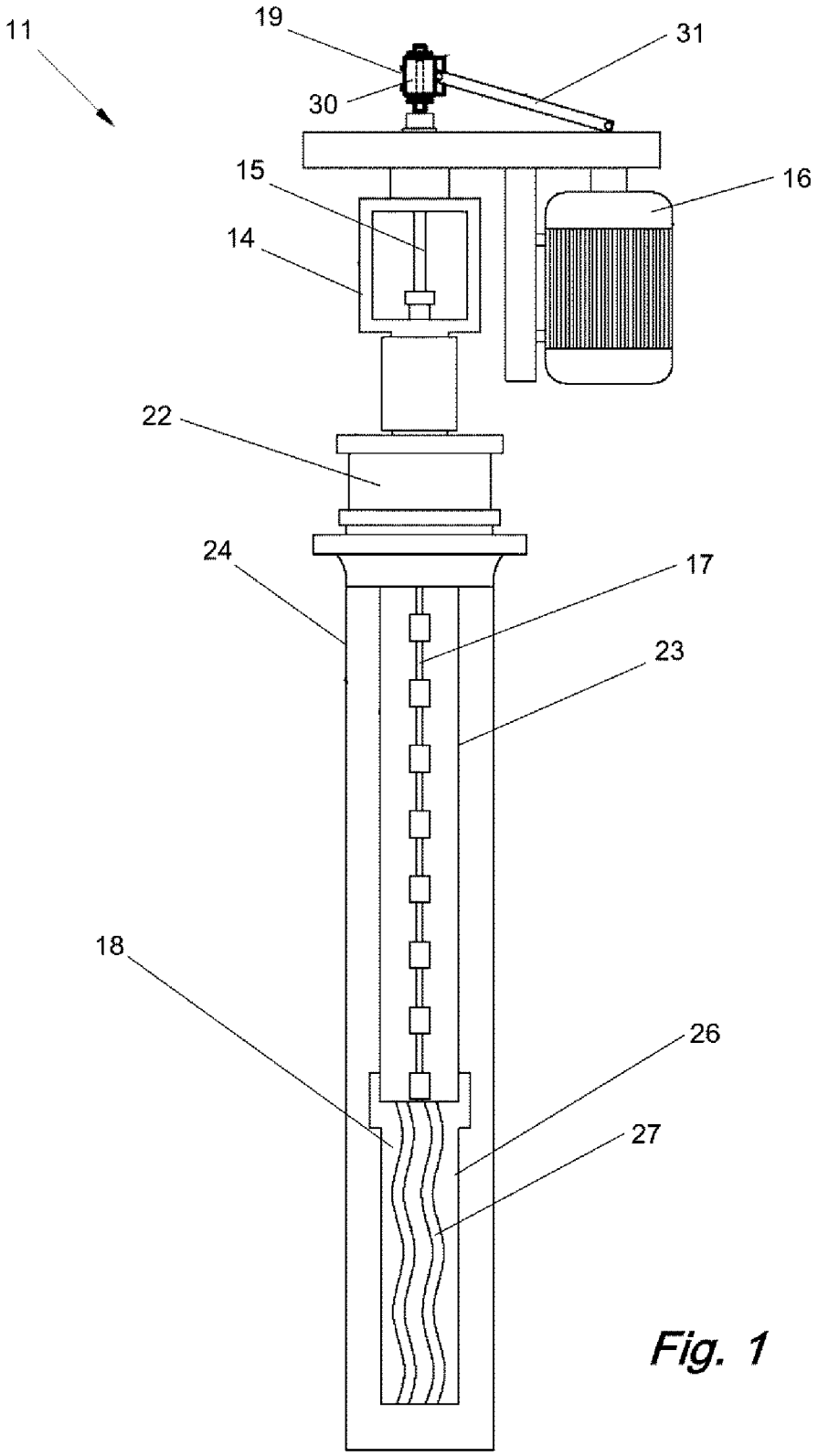
FIG. 1 is a schematic front elevation view of a progressive cavity pump system embodying features of the present invention.
Figure 2:
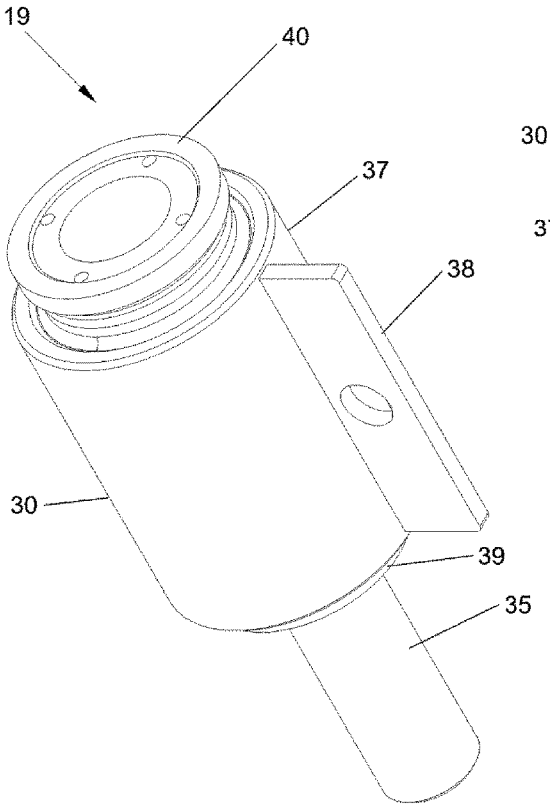
FIG. 2 is a perspective view of the holdback apparatus of the system of FIG. 1.
Figure 3:
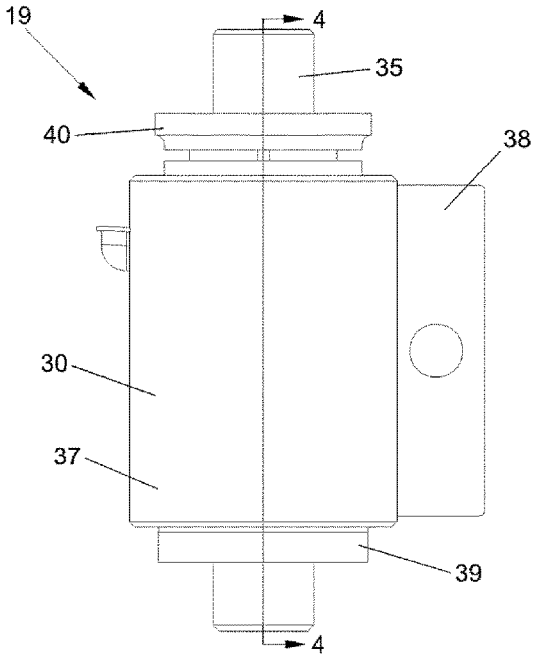
FIG. 3 is a front elevation view of the holdback apparatus of FIG. 2.
Figure 4:
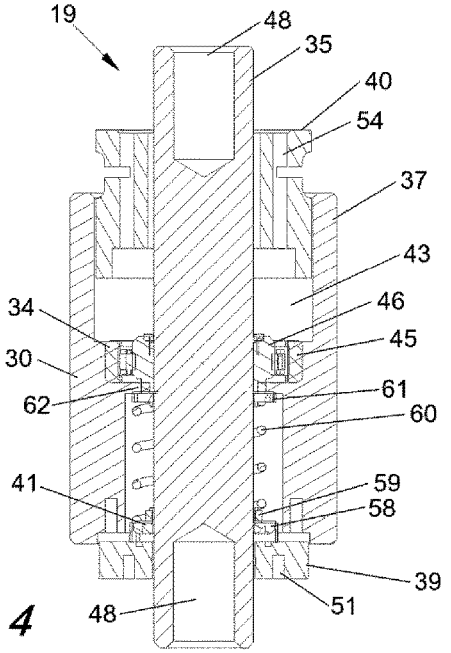
FIG. 4 is a sectional view of the holdback apparatus taken along line 4-4 of FIG. 3.
Figure 5:
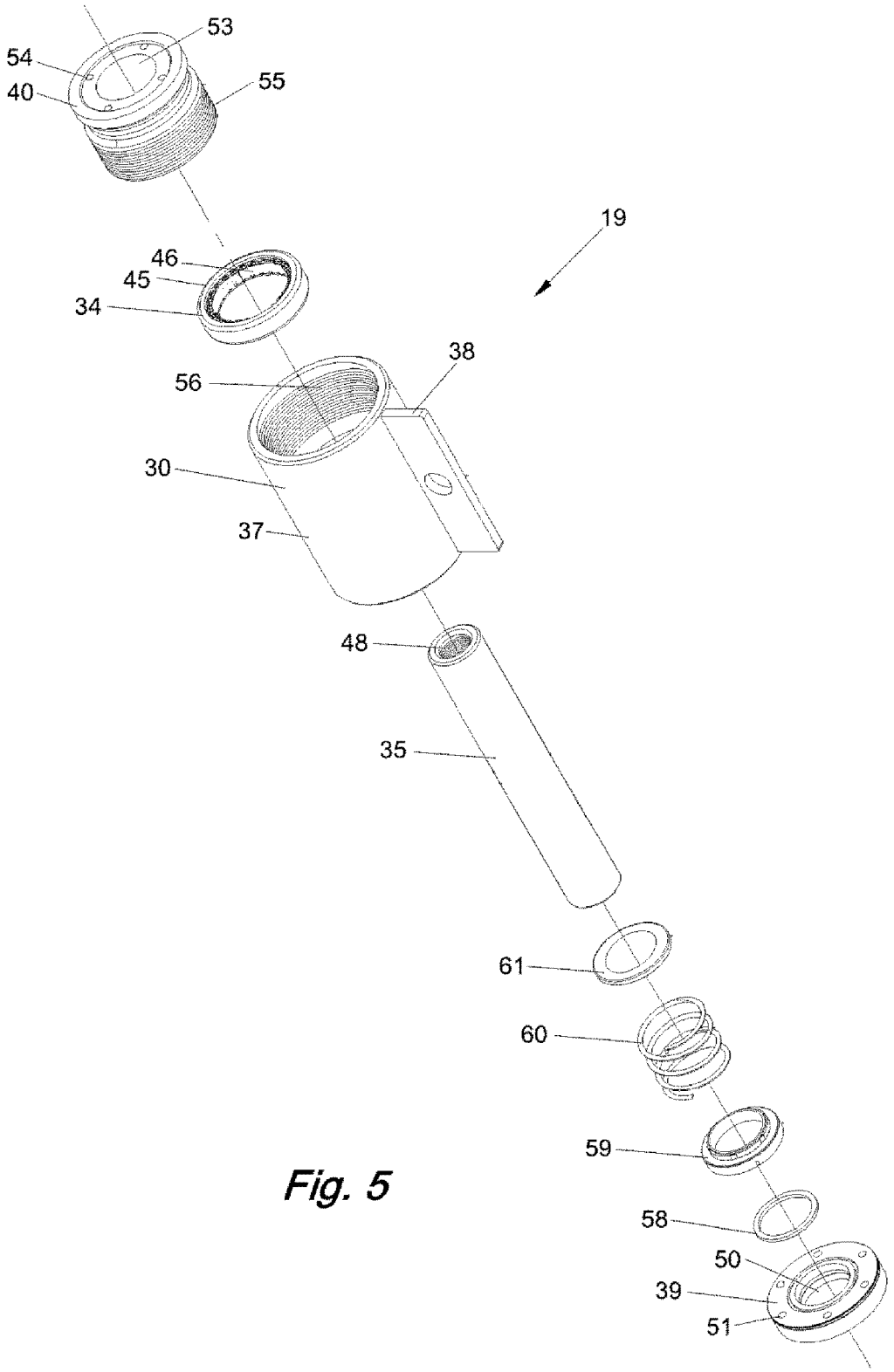
FIG. 5 is an exploded perspective view of the holdback apparatus of FIG. 2.

Referring to FIG. 1, a progressive cavity pump system 11, embodying features of the present invention, includes a drive head 14, a polish rod 15, a motor 16, a sucker rod 17, a progressive cavity pump 18 and a holdback apparatus 19. The drive head 14 mounts on top of a well head 22 at the top of the casing 23 that extends down into the well 24. The polish rod 15 is rotatably mounted in the drive head 14 and extends downwardly through the well head 22.

The motor 16 shown is mounted on the side of the drive head 14. The motor 16 is connected to the polish rod 15 to rotationally drive the polish rod 15. Generally the motor 16 drives the polish rod 15 through a system of belts and sheaves or pulleys, but other drive systems can be used. The sucker rod 17 connects to the lower end of the polish rod 15, extending downwardly, and is rotated by the polish rod 15.

The pump 18 has a stator 26 and a rotor 27 that fits inside the stator 26. The stator 26 is connected to the lower end of the casing 23. The rotor is connected to the lower end of the sucker rod 17 and rotated by the sucker rod 17. The holdback apparatus 19 mounts on the top of the drive head 14, and includes a holdback housing 30 and an elongated retaining arm 31. The retaining arm 31 attaches to the holdback housing 30 at one end, extends radially outwardly, and attaches to the drive head 14 at the other end.

As shown in FIGS. 2-5, the holdback apparatus 19 also includes a one-way bearing 34 and a holdback shaft 35. The holdback housing 30 includes an elongated, substantially cylindrical, hollow body 37, a flange 38, a lower end cap 39, an upper end cap 40 and a seal 41. The flange 38 projects radially outwardly from the body 37 for attachment of the retaining arm 31. The body 37 defines an interior cavity 43.

The one-way bearing 34 has an outer race 45 and an inwardly spaced inner race 46. The inner race 46 is mounted in the outer race 45 and rotatable in the outer race 45 in one direction only. The outer race 45 is sized to be pressed into the interior cavity 43.

The holdback shaft 35 is a cylindrical shaft, preferably of the about the same diameter as the polish rod 15. The inner race 46 is sized to be pressed onto the holdback shaft 35. An internally threaded cavity 48 extends inwardly from each end of the holdback shaft 35. The threaded cavities 48 are sized and threaded to thread onto an externally threaded upper end of the polish rod 15.

The lower end cap 39 has a shaft aperture 50 that the holdback shaft 35 extends through, and a plurality of circumferentially spaced fastener apertures 51 that threaded fasteners (not shown) extend through to fasten the lower end cap 39 to the body 37. The upper end cap 40 has a shaft aperture 53 that the holdback shaft 35 extends through, a plurality of circumferentially ventilation apertures 54 that extend vertically through the upper end cap 40, and external threads 55 that are sized to thread into internal threads 56 at the upper end of the interior cavity 43 to fasten the upper end cap 40 to the body 37.

The seal 41 includes a lower seal race 58, an upper seal race 59, a spring 60, and a seal washer 61. The lower and upper seal races 58 and 59 are generally flat, hollow rings that fit snugly around the holdback shaft 35. The interior cavity 45 in the body 37 has an inwardly projecting lip 62 below the outer race 45. The seal washer 61 is a flat, hollow ring that fits around the holdback shaft 35. The spring 60 is a spiral compression spring that fits around the holdback shaft 35 between the upper seal race 59 and the seal washer 61 to bias the lower and upper seal races 58 and 59 against the lower end cap 39. Oil in the interior cavity 45 cools and lubricates the one-way bearing 34, and the seal 41 prevents leakage of the oil.

Figure 6:
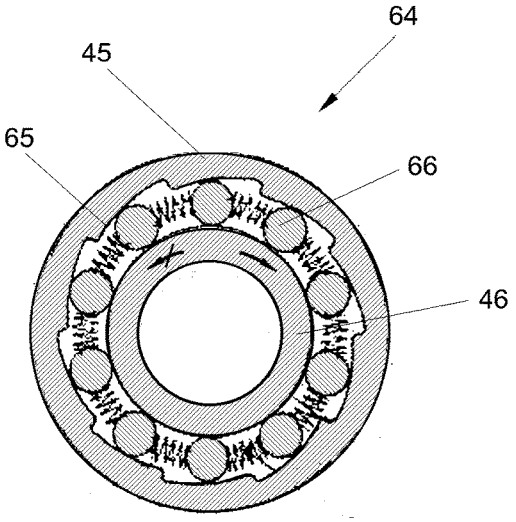
FIG. 6 is a cut-away top plan view of a one-way bearing of the holdback apparatus of FIG. 2.

The one-way bearing 34 can be a ramp and roller clutch 64 as shown in FIG. 6. The ramp and roller clutch 64 shown has a plurality of circumferentially spaced ramps 65 on the inside of the outer race 45 and a plurality of circumferentially spaced rollers 66 between the outer and inner races 45 and 46. The rollers 66 allow the inner race 46 to rotate freely in the clockwise direction and prevent the inner race 46 from rotating in the counterclockwise direction by wedging between the ramps 65 and the inner race 46.

Figure 7:
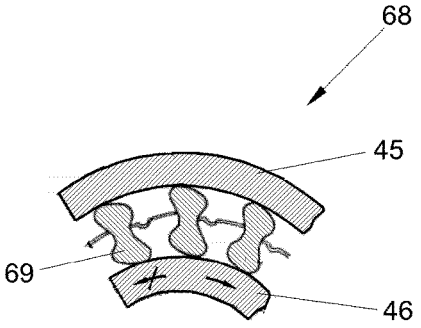
FIG. 7 is a partial cut-away top plan view of an alternative one-way bearing of the holdback apparatus of FIG. 2.

The one-way bearing 34 can alternatively be a sprag clutch 68 as shown in FIG. 7. The sprag clutch 68 shown has a plurality of circumferentially spaced, generally hourglass shaped sprags 69 between the outer and inner races 45 and 46. The sprags 69 allow the inner race 46 to rotate freely in the clockwise direction and prevent the inner race 46 from rotating in the counterclockwise direction by wedging between the outer race 45 and the inner race 46. Other types of one-way clutches and bearings can be used.

If the progressive cavity pump system 11 has a failure below the well head 22, such that the sucker rod 17 needs to be unwound, a rod pin can be threaded into the threaded cavity 48 at the top of the holdback shaft 35. A rod wrench can be applied to the rod pin, the retaining arm 31 can be released, and the sucker rod 17 can be manually unwound.

Figure 8:
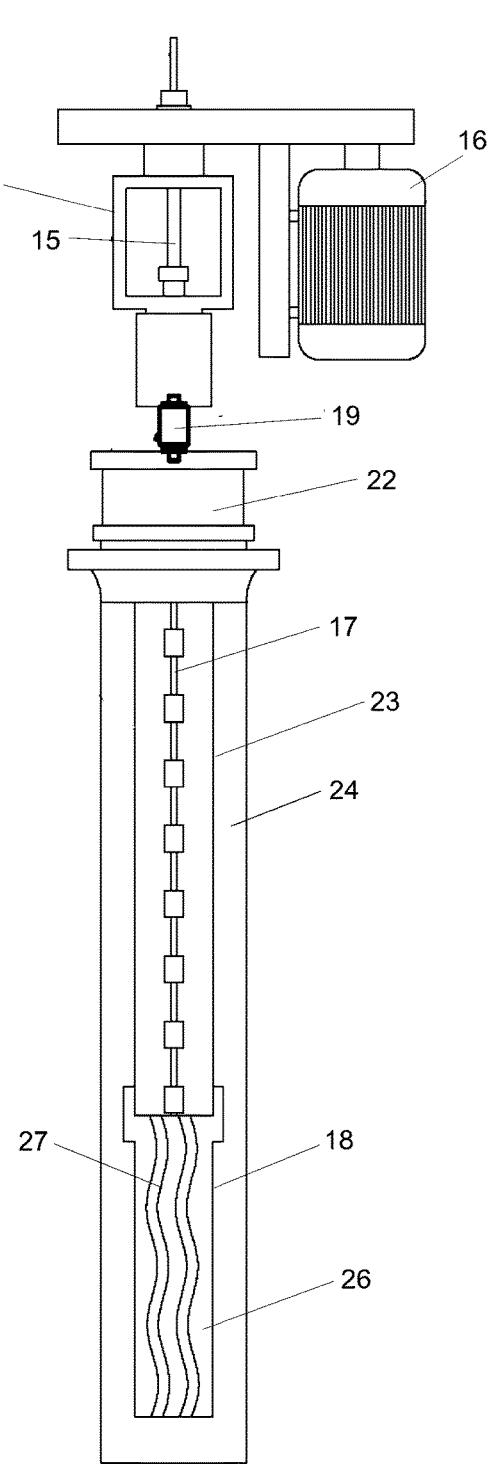
FIG. 8 is a schematic front elevation view of the system of FIG. 1 with an alternative mounting location for the holdback apparatus.

FIG. 8 shows the progressive cavity pump system 11 with the holdback apparatus 19 located below the drive head 14. The holdback housing 30 is integrated with the drive head 14, being either manufactured as part of the drive head 14 or attached to the drive head 14 before the drive head 14 is mounted on the well head 22. Also, the holdback housing 30 can be a part of an existing drive head 14 with the one-way bearing 34 replacing or supplementing an existing bearing.

The progressive cavity pump system 11 prevents the sucker rod 17 from unwinding when the motor 16 loses power and further prevent reverse rotation of the rotor 27, which would allow fluid in the casing 23 above the pump 18 to drain out. The holdback apparatus 19 eliminates rewinding the sucker rod 17 and repumping the fluid when the motor 16 is restarted.

Although the present invention has been described with a certain degree of particularity, it is understood that the present disclosure has been made by way of example and that changes in details of structure may be made without departing from the spirit thereof.

What is claimed is:

1. A holdback apparatus for a polish rod rotatably mounted in a drive head for a progressive cavity pump system having a motor that drives the polish rod, a sucker rod connected to and extending downwardly from the polish rod and a pump driven by the sucker rod, comprising:

a holdback housing rigidly attached to said drive head, and a one-way bearing having an outer race inside and rigidly attached to said holdback housing, and a spaced inner race rotatable in said outer race in a first direction and non-rotatable in said outer race in an opposite second direction, said inner race being connected to said polish rod, whereby said one-way bearing prevents said sucker rod from unwinding when said motor loses power.

2. The apparatus as set forth in claim 1 including a holdback shaft that connects to and extends upwardly from said polish rod and an elongated retaining arm that extends radially outwardly from said holdback housing, and wherein said inner race is rigidly mounted on said holdback shaft, said holdback housing is located above said drive head and said retaining arm is connected to said drive head opposite said housing.

3. The apparatus as set forth in claim 2 wherein said holdback housing includes an elongated, substantially cylindrical, hollow body and a flange that projects radially outwardly from said body, said body defining an interior cavity with said outer race being sized to press fit into said cavity, and said flange connecting said retaining arm to said holdback housing.

4. The apparatus as set forth in claim 2 wherein said holdback shaft includes a lower end with an internally threaded cavity that is sized to connect to an externally threaded upper end of said polish rod.

5. The apparatus as set forth in claim 1 wherein said holdback housing is an integral part of said drive head and said inner race is sized to receive and grip said polish rod.

6. The apparatus as set forth in claim 1 wherein said one-way bearing is a ramp and roller clutch.

7. The apparatus as set forth in claim 1 wherein said one-way bearing is a sprag clutch.

8. A holdback apparatus for a polish rod rotatably mounted in a drive head for a progressive cavity pump system having a motor that drives the polish rod, a sucker rod connected to and extending downwardly from the polish rod and a pump driven by the sucker rod, comprising:

a holdback housing above said drive head, an elongated retaining arm that extends radially outwardly from said holdback housing and attaches to said drive head, a one-way bearing having an outer race inside and rigidly attached to said holdback housing, and a spaced inner race rotatable in said outer race in a first direction and non-rotatable in said outer race in an opposite second direction, and a holdback shaft that connects to and extends upwardly from said polish rod, said holdback shaft being received and gripped by said inner race, whereby said one-way bearing prevents said sucker rod from unwinding when said motor loses power.

9. A progressive cavity pump system for a well having a well head and a casing extending downwardly from said well head, comprising:

a drive head mounted on said well head, a polish rod rotatably mounted in said drive head, a motor that drives said polish rod, a sucker rod connected to and extending downwardly from said polish rod, a pump connected to said sucker rod opposite said polish rod and driven by said sucker rod, a holdback housing rigidly attached to said drive head, and a one-way bearing having an outer race inside and rigidly attached to said holdback housing, and a spaced inner race rotatable in said outer race in a first direction and non-rotatable in said outer race in an opposite second direction, said inner race being connected to said polish rod, whereby said one-way bearing prevents said sucker rod from unwinding when said motor loses power.

10. The system as set forth in claim 9 including a holdback shaft that connects to and extends upwardly from said polish rod and an elongated retaining arm that extends radially outwardly from said holdback housing, and wherein said inner race is rigidly mounted on said holdback shaft, said holdback housing is located above said drive head and said retaining arm is connected to said drive head opposite said housing.

11. The system as set forth in claim 10 wherein said holdback housing includes an elongated, substantially cylindrical, hollow body and a flange that projects radially outwardly from said body, said body defining an interior cavity with said outer race being sized to press fit into said cavity, and said flange connecting said retaining arm to said holdback housing.

12. The system as set forth in claim 10 wherein said holdback shaft includes a lower end with an internally threaded cavity that is sized to connect to an externally threaded upper end of said polish rod.

13. The system as set forth in claim 9 wherein said holdback housing is an integral part of said drive head and said inner race is sized to receive and grip said polish rod.

14. The system as set forth in claim 9 wherein said one-way bearing is a ramp and roller clutch.

15. The system as set forth in claim 9 wherein said one-way bearing is a sprag clutch.

* * * * *